United States Patent [19]

Gunther

[11] 4,217,066

[45] Aug. 12, 1980

[54] DIVING BELL UMBILICAL CONVEYOR SYSTEM

[76] Inventor: Albert W. Gunther, P.O. Box 615, Harvey, La. 70059

[21] Appl. No.: 883,249

[22] Filed: Mar. 3, 1978

[51] Int. Cl.[2] ..... B63C 11/00

[52] U.S. Cl. ..... 405/185; 254/265

[58] Field of Search ..... 226/170, 171, 172, 173, 226/174, 178, 108, 181, 182, 188, 50; 254/175.5, 175.6, 175.7; 405/165, 168, 174, 177, 185

[56] References Cited

U.S. PATENT DOCUMENTS

| | | | |
|---|---|---|---|
| 3,243,090 | 3/1966 | Shibata | 226/181 |
| 3,285,485 | 11/1966 | Slator | 226/172 |
| 3,302,838 | 2/1967 | Thaler | 254/175.5 |
| 3,310,213 | 3/1967 | Gretter | 226/172 |
| 3,313,346 | 4/1967 | Cross | 166/0.5 |
| 3,589,580 | 6/1971 | Smulders | 226/108 |
| 3,641,778 | 2/1972 | Gibson | 61/72.1 |
| 3,804,372 | 4/1974 | Fuchs | 254/190 |
| 3,934,482 | 1/1976 | Byers | 74/230.7 |
| 3,982,402 | 9/1976 | Lang et al. | 61/109 |
| 4,013,205 | 3/1977 | Thiery et al. | 226/173 |

FOREIGN PATENT DOCUMENTS

| | | | |
|---|---|---|---|
| 2206411 | 8/1973 | Fed. Rep. of Germany | 405/168 |

*Primary Examiner*—H. Grant Skaggs

*Attorney, Agent, or Firm*—Arnold, White & Durkee

[57] ABSTRACT

An umbilical conveyor system for a diving bell, including an umbilical conveyor, a pressure wheel, and hydraulic motors for the conveyor. The conveyor is designed to feed umbilical life support lines from a diving bell into or out of a storage location over a controlled radius of curvature, thereby preventing binding, kinking, or stretching of the umbilical. The hydraulic motors maintain the rate of feed of the umbilical equal to the rate at which the diving bell is raised or lowered, while the pressure wheel insures that the conveyor system will firmly grip the umbilical.

7 Claims, 3 Drawing Figures

DIVING BELL UMBILICAL CONVEYOR SYSTEM

BACKGROUND OF THE INVENTION

1. Field of the Invention

This invention relates to cable support mechanisms, and more particularly, to a support mechanism for diving bell umbilicals.

2. Description of the Prior Art

Diving bells are frequently used in connection with industrial or research operations requiring personnel to carry out duties at locations under water. Such a diving bell provides a pressurized and water tight environment in which men may safely work at extreme water depths.

A diving bell operation is typically conducted from a support vessel anchored at sea. Men and equipment are placed into the diving bell and the bell is lowered to the desired water depth.

A common practice is to support the diving bell from a steel cable attached to a wench, the wench being used to raise and lower the diving bell. Life support lines, which supply electrical power, air, communications circuits, and the like, must also pass from the support ship to the diving bell. The life support lines are commonly banded together into one cable, and that cable inturn is banded to the steel support cable as the diving bell is lowered.

The presence of these life support lines, known as the umbilical cable, presents some difficulty in raising and lowering the diving bell. Because such lines are relatively fragile and subject to damage through kinking, twisting, or stretching, it is important to carefully control the manner in which the umbilical is employed or collected as the diving bell is lowered or raised.

In the past, one method which has been employed is to manually feed the umbilical over the side of the support ship as the diving bell is lowered, and to manually coil or collect the umbilical on deck as the diving bell is raised. Since the umbilical line tends to be relatively large and heavy, however, manual handling of the line is difficult and frequently is not adequate.

Another method of controlling the umbilical involves storing the umbilical on a drum which is rotated by a wench. In order to accommodate the rotary motion of the drum, however, this method makes it necessary to connect each support line to its source through a slip ring and collector arrangement. Because such slip rings and collectors may leak or fail, this method may degrade the safety and reliability of the diving operation. Consequently, a need has developed in the art for a safe, reliable, and mechanized apparatus for controlling the umbilical cable for a diving bell.

Therefore, it is a feature of this invention to provide an umbilical conveyor system which obviates the need for slip rings and collectors within the diving bell life support lines.

It is another feature of this invention to provide an umbilical conveyor system which establishes an adjustable pull on the umbilical so that the umbilical is fed or collected at a rate commensurate with the speed at which the diving bell is lowered or raised.

It is an additional feature of this invention to provide an umbilical conveyor system which will grip the umbilical and may provide an auxiliary means of support for the diving bell in the event the support cable is broken.

It is also a feature of this invention to provide an umbilical conveyor system which guides the umbilical around a predetermined minimum radius of curvature, thereby preventing crimping, twisting, binding, and kinking, and the like, of the life support lines.

It is yet another feature of this invention to provide an umbilical conveyor system which is rotatably and laterally adjustable to accommodate variations in the location of the diving bell and the storage location for the umbilical.

SUMMARY OF THE INVENTION

A diving bell umbilical conveyor system provides a support for transferring an umbilical cable from a stored location as the diving bell is lowered. The conveyor system includes a conveyor having at each end endless chains fitted with cleets adapted to grip the umbilical. A pressure wheel empinges on the umbilical adjacent one end of the conveyor system to ensure a firm gripping contact between the umbilical and the cleets. Drive means connected to each endless chain cause the endless chains to rotate about sprokets at a speed so that the umbilical follows the speed at which the driving bell is raised or lowered. In the event the diving bell support cable breaks, the umbilical conveyor system will automatically deploy the umbilical as the diving bell lowers to a rest position. The umbilical passes over a predetermined minimum radius of curvature at either end of the conveyor system, thereby preventing deformation of the life support lines in the umbilical.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DESCRIPTION OF THE PREFERRED EMBODIMENTS

Figure 1:
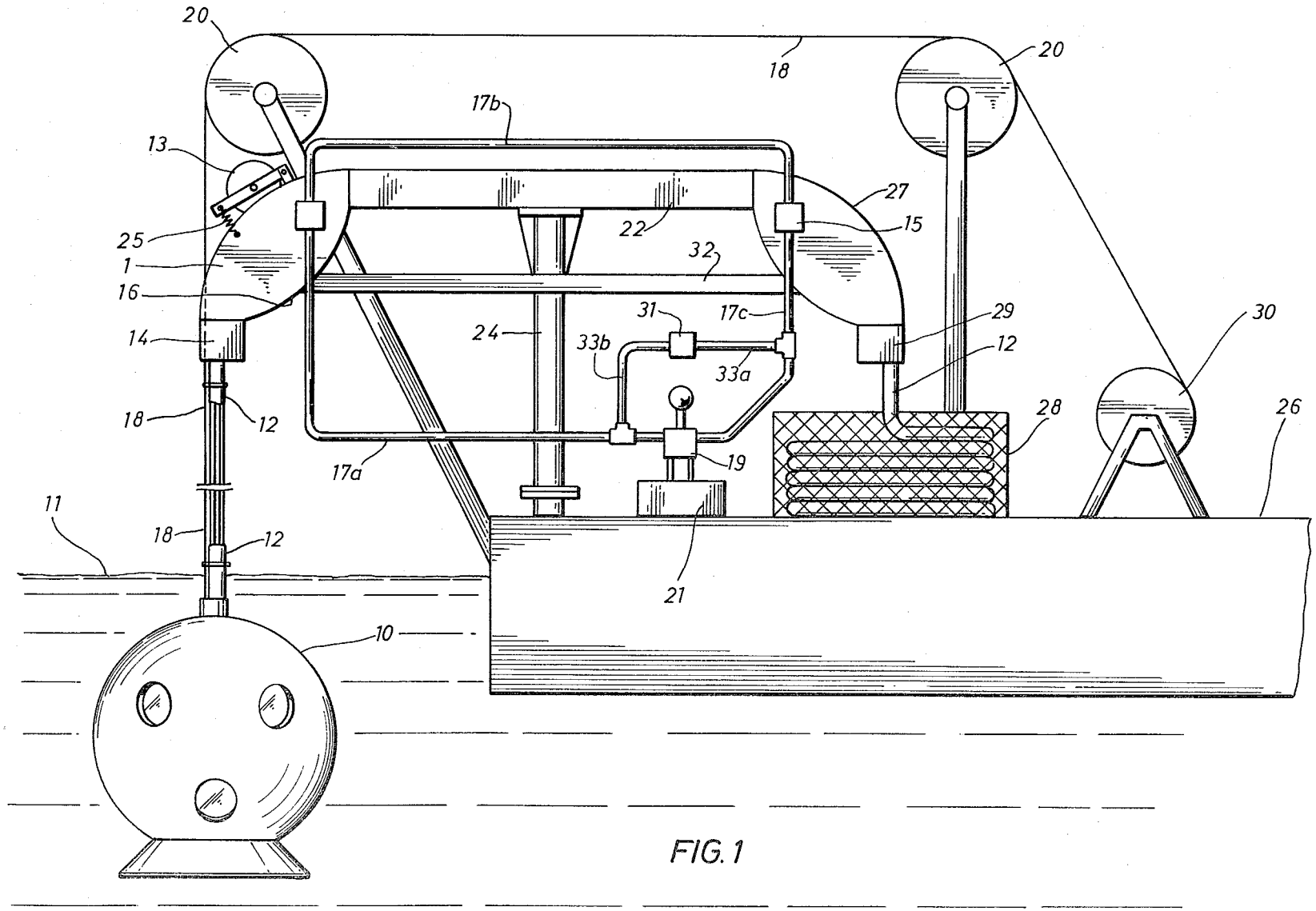
FIG. 1 shows the umbilical cable conveyor system installed in a typical application to raise and lower a diving bell.

Referring first to FIG. 1, which illustrates a typical installation of the diving bell umbilical conveyor system 1, diving bell 10 is shown suspended beneath the water level 11 by a steel support cable 18. The steel support cable 18 passes over two support pulleys 20 and terminates on wench 30 which provides the raising and lowering power to the diving bell 10. Umbilical cable 12, which supplies the life support systems to the diving bell, such as the electrical power, gas, air, communications, etc., and the steel support cable 18 pass through the umbilical feeder guide 14 of the umbilical conveyor end support assembly 16 located above the diving bell 10. The umbilical cable 12 is supported and contained within the umbilical conveyor end support assemblies 16 and 27 and the spacing member 22. The umbilical cable 12 emerges from the opposite umbilical feeder guide 29 and is fed into a cable storage bin 28. While a cable storage bin 28 is shown, other means for receiving and storing the umbilical cable may be used, such as allowing the cable to lie on the deck of support 26.

The umbilical conveyor system 1 is comprised of two identical umbilical conveyor end support assemblies 16 and 27 connected together by support members 22 and 32. Attached to each end of the umbilical conveyor end support assemblies 16 and 27 are umbilical feeder guides 14 and 29, respectively. Umbilical feeder guides 14 and 27 serve to guide the umbilical cable into the gripping parts of the end support assemblies 16 and 27 which provide the lifting force to lift the umbilical cable. To enable the diving bell umbilical conveyor system 1 to operate in both directions to lower and raise the diving bell, the two umbilical conveyor end support assemblies 16 and 27 operate identically. Mounted to umbilical conveyor end support assembly 16 is pressure wheel 13 that provides a compressive force to umbilical cable 12 as it passes through the assembly 16. This compressive force prevents the umbilical cable from jumping out of the support assembly 16 and causes the cable griping parts of the assembly to grip harder. Pressure wheel 13 is urged into contact with the umbilical cable by spring 25. Other ways of urging the pressure wheel into contact with the umbilical cable are possible, such as a motor, that are obvious to those skilled in the art. Mounted in the center of support member 22 is swivel 24 which supports the umbilical conveyor system 1 and permits rotation of the entire conveyor system necessitated by the relative motion of the diving bell 10 in respect to the platform 26.

Mounted to the umbilical conveyor end support assemblies 16 and 27 are hydraulic motors 15 which provide the lifting force to convey the umbilical cable 12 through the conveyor system 1. Pressurized hydraulic fluid is provided to hydraulic motors 15 through supply lines 17*a*, 17*b* and 17*c* and directional valve 19. Hydraulic pump 21 provides supply lines 17*a*, 17*b* and 17*c* with pressurized fluids. Directional valve 19 changes the direction of the rotation of the hydraulic motors 15 according to whether the diving bell is being raised or lowered. Connected between supply lines 17*a* and 17*c* is pressure relief valve 31 which regulates the pressure in supply line 17*a* in relation to 17*c*. That is, the pressure relief valve 31 only regulates the pressure in line 17*a* when the hydraulic motors 15 are being driven to hoist the umbilical cable when the diving bell 10 is being raised. The high side of pressure relief valve 31 is connected to supply line 17*a* by supply line 33 while the low side is connected to line 17*c* by line 33*a*. The relief valve is set to regulate a certain pressure so that the directional valve 19 can be placed in the full flow position. At the desired torque for hydrualic motors 15, the pressure relief valve 31 regulates the supply line 17*a* pressure to keep the hydraulic motor torque constant. If the diving bell should be lowered while the hydraulic motors are being driven, the umbilical cable will continue to experience a constant tensional pull from the conveyor system in the same direction although the hydraulic motros will rotate in an opposite direction becoming a pump rather than a motor. The weight of the diving bell 10 provides the energy to change the direction of rotation of the driven hydraulic motors 15. When the diving bell 10 is being lowered, hydraulic motors 15 are driven in a direction to lift the umbilical cable 12 from the cable storage bin 28. The opposite is true when the diving bell is being raised.

Figure 2:
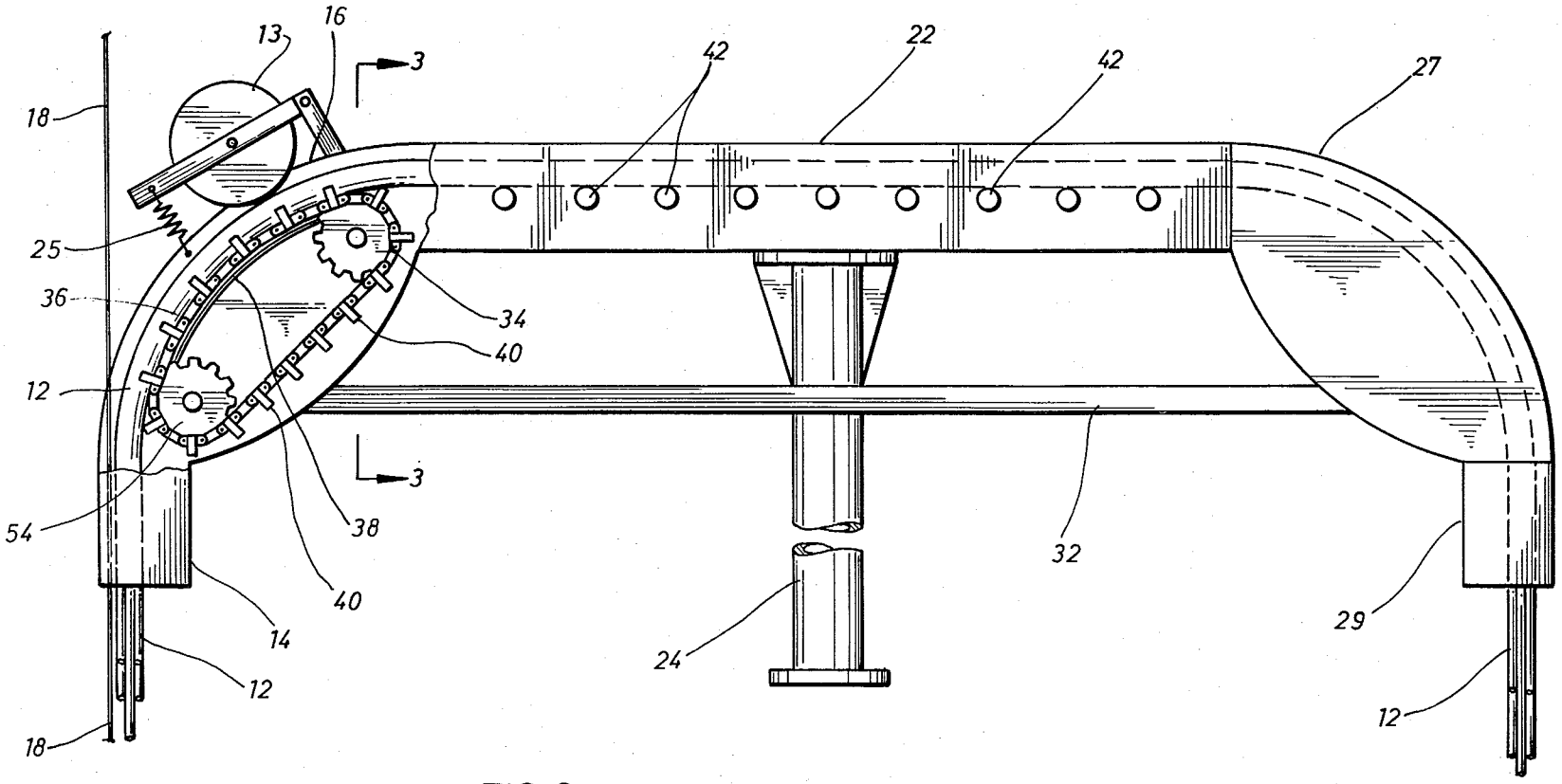
FIG. 2 is a partial cutaway drawing of the umbilical cable conveyor system.

Referring now to FIG. 2, which shows a partial cutaway view of the umbilical conveyor system 1, the internal umbilical cable gripping and supporting mechanism of the umbilical conveyor end support assembly is shown. The umbilical cable 12 and steel support cable 18 are shown passing through umbilical feeder guide 14 whereupon the umbilical cable 12 is engaged by a series of rubber cleats 40 mounted to an endless chain 36 that passes around two sprocketed wheels 34 and 54. Pressure wheel 13 is shown urging umbilical cable 12 into contact with cleats 40 as they pass beneath the wheel. Mounted to sprocket wheel 34, but not shown, is one of the hydraulic motors 15 (see FIG. 1). Rotation of sprocket wheel 34 causes chain 36 to rotate. Since a number of the rubber cleats 40 are gripping umbilical cable 12, rotation of chain 36 provides a pulling force on umbilical cable 12. The combined force exerted on cable 12 from the two conveyor end support assemblies 16 and 27 propel it through the umbilical conveyor system 1. The identical operation as just discussed for conveyor end assembly 16 occurs in the umbilical conveyor end support assembly 27. As the umbilical cable 12 passes through the spacing member 22, a series of roller guides 42 support and guide the umbilical cable 12 until it enters conveyor end assembly 27.

The bend angle or radius of curvature through which the umbilical support cable 12 passes as it travels through the umbilical end support assemblies 16 and 27 must be greater than a predetermined minimum to avoid damage from crinkling to the cable. The bend angle is controlled by the bend radius guides 38 over which the rubber cleats 40 pass. Spacing member 22 is designed such that the spacing between the umbilical conveyor end support assemblies 16 and 27 may be varied as required by the particular installation in which the umbilical conveyor system 1 will be used.

Figure 3:
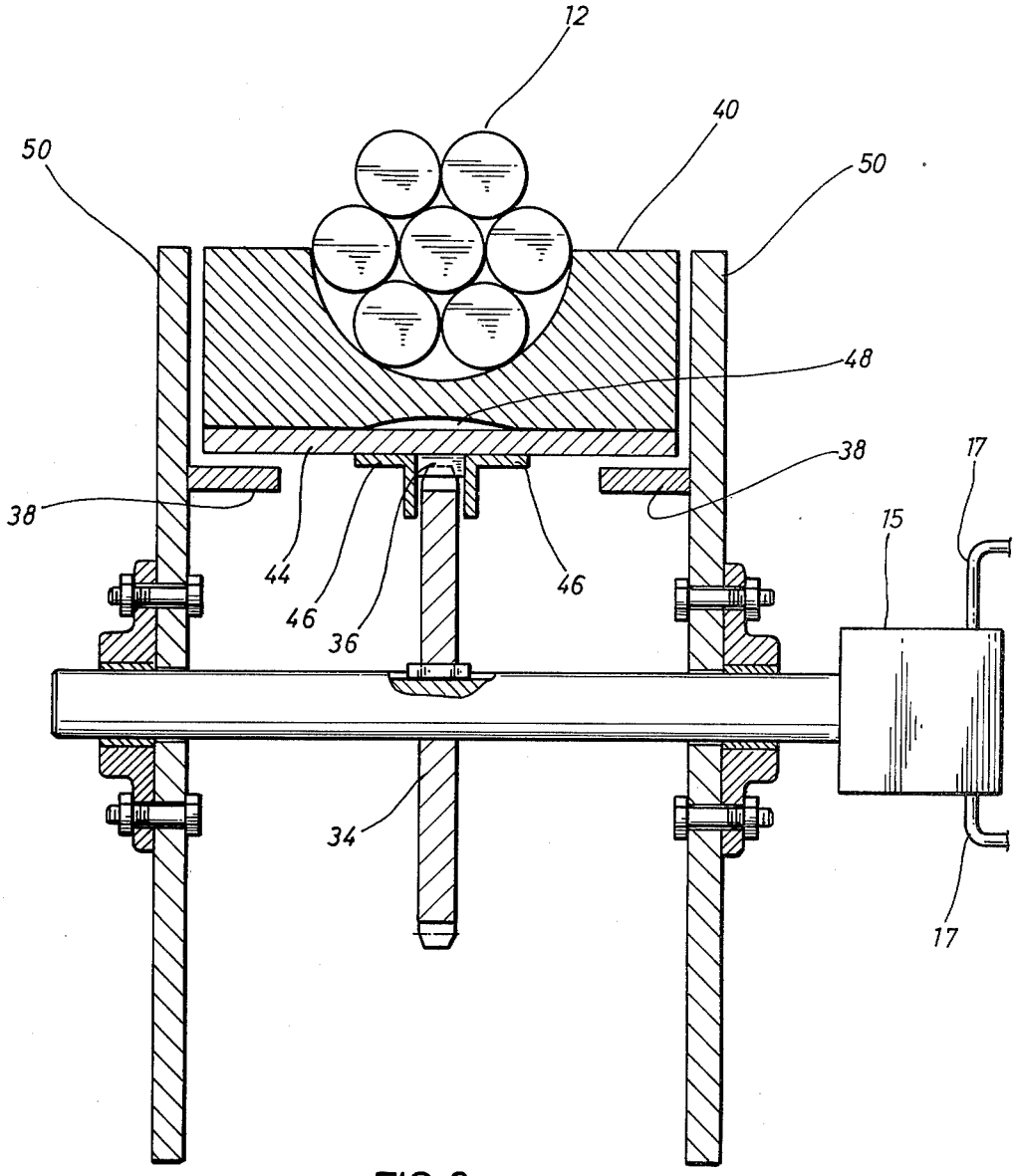
FIG. 3 is a cross-sectional view of the umbilical conveyor end support assembly.

Referring now to FIG. 3, which shows a cross-sectional view of the umbilical conveyor end support assembly 16 taken through sprocket wheel 34, rubber cleat 40 is shown engaging umbilical cable 12. Rubber cleat 40 is mounted to a steel plate 44 which in turn is mounted to a link in chain 36 by brackets 46. Sprocket wheel 34 is shown engaging chain 36 such that rotation of sprocket wheel 34 propels rubber cleat 40 which in turn pulls on umbilical cable 12. A cutout 48 in rubber cleat 40 is provided to allow rubber cleat 40 to compress against the sides of umbilical cable 12 which is being urged into contact with the rubber cleat 40 by the pressure wheel 13 (see also FIG. 2). The steel plate 44 on which rubber cleat 40 is mounted passes over and is guided and supported by the bend radius guides 38. Sprocket wheel 34 is shown connected to the shaft of hydraulic motor 15 which supplies the rotation torque to the wheel.

In operation, the diving bell umbilical conveyor system 1 is used with an umbilical cable whose length is greater than the greatest expected depth of water in which the diving bell will be lowered. This is a safety feature which assures that should the support cable 18 break and cause the diving bell 10 to settle to the bottom, life support systems to the diving bell crew will not be lost because the umbilical cable was not long enough. The hydraulic motors which are providing the pulling force on the umbilical cable 12 provide a constant torque drive to the upper sprocket wheels located in each of the umbilical conveyor end support assemblies 16 and 27. The torque is adjustable and is selected to provide the necessary lifting force to propel the umbilical cable through the conveyor system. In the event that the support cable 18 breaks and the umbilical cable is pulled through the conveyor system by the weight of the diving bell, the hydraulic motors 15 will continue to exert a constant force on umbilical cable 12 as the diving bell 10 descends into the water. This constant torque helps to slow the diving bell's rate of descent. If umbilical cable 12 should have a nylon rope as part of the cable, hydraulic motors 15 could be used to support the weight of the diving bell 10 when suspended in the water and prevent its settling to the bottom.

As the diving bell 10 is lowered into the water, umbilical cable 12 is lifted out of the umbilical cable storage bin 28 by positioning directional valve 19 to rotate the hydraulic motors 15 in the appropriate direction. Pressure wheel 13 urges umbilical cable 12 against the rubber cleats of the umbilical conveyor end support assembly 16 positioned above the diving bell 10. At regular intervals, the umbilical cable 12 is taped to the support cable 18 to prevent separation of the two cables as the diving bell descends deeper into the water. When the diving bell is raised, the reverse sequence as described above occurs.

The diving bell umbilical conveyor system 1 is supported in the center by a swivel 24 which permits rotation about a vertical axis of the entire conveyor system. This freedom of rotation in the conveyor system is necessitated by the relative motion between the support surface 26 and the diving bell 10 caused by the wave action of the water 11.

In describing the invention, reference has been made to a preferred embodiment. However, those skilled in the art and familiar with the disclosure of the invention may recognize additions, deletions, substitutions or other modifications which would fall within the perview of the invention as defined in the appended claims.

What is claimed is:

1. A device for handling an umbilical life support cable for a submerged diving bell suspended by a lifting cable from a platform, comprising:

(a) a rotatable umbilical cable conveyor, for guiding the movement of the umbilical cable from the platform to the diving bell as the diving bell is raised and lowered in the water, said conveyor rotating about a pivot point to permit relative motion between the diving bell and the platform;

(b) an umbilical cable gripping means mounted in said conveyor, for gripping the umbilical cable without crimping to transmit a lifting force to the umbilical cable; and (c) a drive means associated with said gripping means, for providing a constant moving force to the umbilical cable thereby to convey the cable through said conveyor as the diving bell is raised or lowered, and for providing an emergency lifting force to the diving bell to slow the descent of the diving bell should the lifting cable break.

2. The device of claim 1 wherein said conveyor guides the umbilical cable through an angle having a predetermined radius of curvature as the diving bell is raised and lowered, the radius of curvature large enough to prevent damage due to bending of the umbilical cable.

3. The device of claim 1 wherein said umbilical cable gripping means comprises:

(a) a first cable gripping assembly at a first end of said conveyor, said first gripping assembly gripping and guiding the umbilical cable as it exits from the conveyor to the diving bell; and (b) a second cable gripping assembly at a second end of said conveyor, said second gripping assembly gripping and guiding the umbilical cable as it exits from the conveyor to the platform.

4. The device of claim 3 wherein said first and second gripping assemblies each comprise:

(a) an endless chain;

(b) a plurality of gripping cleats attached to said chain and positioned for gripping the outer surface of the umbilical cable as it passes through said assembly;

(c) first and second sprocket wheels, said chain passing around each said sprocket wheel, for moving said chain in a prescribed path; and (d) a guide plate located between said first and second sprocket wheels and positioned beneath an upper length of said chain, said upper length of said chain defined by the section of chain between said wheels having the cleats in contact with the umbilical cable, for supporting and guiding through the angle the umbilical cable in contact with said cleats on the upper length of said chain.

5. The device of claim 4 wherein said first cable gripping assembly has associated therewith a pressure wheel for urging the umbilical cable into further contact with said cleats thereby preventing the umbilical cable from jumping out of contact with said cleats.

6. The device of claim 3 wherein said drive means comprises:

(a) a supply of pressurized hydraulic fluid;

(b) a directional valve having a first and second supply line connected thereto and connected to said supply, for selectively applying fluid to the first or second supply line;

(c) first and second hydraulic motors respectively associated with said first and second umbilical cable gripping assemblies and respectively connected to said directional valve by the first and second supply lines, said hydraulic motors further connected in series so that said directional valve selects the direction of rotation of said motors to be the same; and (d) a pressure regulating valve connected between the first and second supply lines, for regulating the pressure in the first supply line relative to the second supply line to cause said hydraulic motors to deliver a constant torque to its respective gripping assembly, said supply and said regulating valve cooperating together to permit said motors to rotate in the opposite direction from their driven direction while maintaining a constant lifting force on the umbilical cable in the event that the lifting cable should break, thereby to lower the diving bell to the bottom without breaking the life support umbilical cable.

7. The device of claim 1 wherein said drive means comprises:

(a) a supply of pressurized hydraulic fluid;

(b) a hydraulic motor connected to said supply and said gripping means, for delivering a torque to said gripping means thereby to generate a lifting force on the umbilical cable; and (c) a pressure regulating valve, for regulating the pressure of the fluid supplied to said motor to cause said motor to deliver a constant torque to said gripping means, said supply and said valve cooperating together to permit said motor to rotate in the opposite direction from its driven direction while maintaining a constant lifting force on the umbilical cable in the event that the lifting cable should break, thereby to lower the diving bell to the bottom without breaking the life support umbilical cable.

* * * * *